US005293129A

United States Patent [19]

Ikeuchi et al.

[11] Patent Number: 5,293,129

[45] Date of Patent: Mar. 8, 1994

[54] IONIC CURRENT SENSING APPARATUS FOR ENGINE SPARK PLUG WITH NEGATIVE IGNITION VOLTAGE AND POSITIVE DC VOLTAGE APPLICATION

[75] Inventors: Masayuki Ikeuchi; Shigemi Murata; Toshio Iwata; Toshio Ohsawa; Takanobu Yonetsu, all of Himeji, Japan

[73] Assignee: Mitsubishi Denki Kabushiki Kaisha, Tokyo, Japan

[21] Appl. No.: 783,908

[22] Filed: Oct. 29, 1991

[30] Foreign Application Priority Data

| | | | |
|---|---|---|---|
| Nov. 9, 1990 | [JP] | Japan | 2-304778 |
| Nov. 9, 1990 | [JP] | Japan | 2-304779 |
| Nov. 9, 1990 | [JP] | Japan | 2-304780 |
| Nov. 9, 1990 | [JP] | Japan | 2-304781 |

[51] Int. Cl.[5] ..... F02P 17/00; F02P 9/00

[52] U.S. Cl. ..... 324/399; 324/385; 324/388; 324/402; 123/425

[58] Field of Search ..... 324/378, 384, 385, 388, 324/390, 391, 392, 393, 399, 402; 123/169 EL, 169 G, 169 R, 425, 618, 620

[56] References Cited

U.S. PATENT DOCUMENTS

| | | | |
|---|---|---|---|
| 3,035,224 | 5/1962 | Whaley et al. | 342/399 |
| 4,491,110 | 1/1985 | Bone et al. | 123/425 |
| 4,648,367 | 3/1987 | Gillbrand et al. | 123/425 |
| 5,087,882 | 2/1992 | Iwata | 324/388 |

FOREIGN PATENT DOCUMENTS

| | | |
|---|---|---|
| 3339569 | 5/1985 | Fed. Rep. of Germany . |
| 3342723 | 7/1986 | Fed. Rep. of Germany . |
| 2-301673 | 12/1990 | Japan . |

OTHER PUBLICATIONS

Motortechnische Zeitschrisft 51 (1990) 3, pp. 118–122.

*Primary Examiner*—Gerard R. Strecker
*Assistant Examiner*—Diep Do
*Attorney, Agent, or Firm*—Sughrue, Mion, Zinn, Macpeak & Seas

[57] ABSTRACT

A direct current power supply applies a positive voltage between the center electrode and the ground electrode of a spark plug in an internal combustion engine after discharge of the spark plug. Ionic current flowing between the electrodes due to the positive voltage is measured by a current sensor. The ionic current caused by the positive voltage is due to electrons, so it has a large magnitude and can be easily measured.

5 Claims, 6 Drawing Sheets

IONIC CURRENT SENSING APPARATUS FOR ENGINE SPARK PLUG WITH NEGATIVE IGNITION VOLTAGE AND POSITIVE DC VOLTAGE APPLICATION

BACKGROUND OF THE INVENTION

This invention relates to an apparatus for sensing ionic current flowing between the electrodes of a spark plug in an internal combustion engine.

In a spark ignited internal combustion engine, the spark generated by a spark plug at the time of ignition produces ionization of the air in the cylinder. If a voltage is applied between the electrodes of the spark plug when ions are present, an ionic current is generated between the electrodes. By measuring the ionic current, it is possible to determine whether the cylinder in which the spark plug is disposed misfired based on the magnitude of the ionic current. Furthermore, the magnitude of the ionic current during the combustion stroke of a cylinder is highest when the pressure in the cylinder reaches a maximum, so the ionic current can be used to monitor pressure variations within a cylinder.

Conventional ionic current sensing devices have a power supply connected to a spark plug so as to apply a negative voltage between the center electrode and the ground electrode of the spark plug to produce an ionic current in the form of positive ions. An electric current flowing due to the ionic current through a current sensing resistor connected in series with the power supply is then measured as an indication of the ionic current. However, since the positive ions generating the ionic current have a large mass and a low velocity, the magnitude of the electric current flowing through the current sensing resistor is extremely small and difficult to measure.

SUMMARY OF THE INVENTION

Accordingly, it is an object of the present invention to provide an ionic current sensing apparatus for an internal combustion engine which generates a large ionic current that is easy to measure.

It is another object of the present invention to provide an ionic current sensing apparatus that can be easily applied to a conventional ignition system for an internal combustion engine.

It is yet another object of the present invention to provide an ionic current sensing method for an internal combustion engine.

In an ionic current sensing apparatus according to the present invention, a positive voltage is applied between the center electrode and the ground electrode of a spark plug for a cylinder of an internal combustion engine. When the spark plug discharges and produces ions, the positive voltage between the electrodes of the spark plug produces an ionic current due to the flow of electrons. Since electrons have a much lower mass and a much higher velocity than positive ions, the ionic current is large and easy to measure.

In an ionic current sensing method according to the present invention, a positive voltage is applied between the center electrode and the ground electrode of a spark plug for a cylinder of an internal combustion engine. The current that flows through a current sensor connected in series with the power supply due to the ionic current that flows between the electrodes due to the positive voltage is then measured after the spark plug has fired.

The present invention can be applied to various types of ignition systems. For example, the ignition system can be with or without a distributor and with or without breaker points.

DESCRIPTION OF THE PREFERRED EMBODIMENTS

Figure 1:
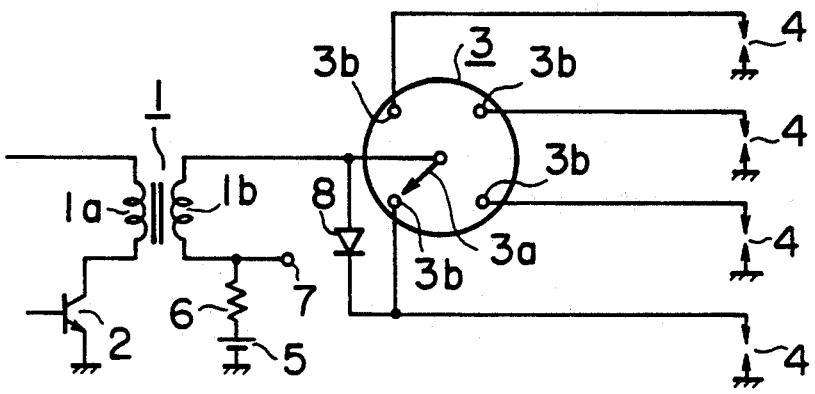
FIG. 1 is a circuit diagram of a first embodiment of an ionic current sensing apparatus according to the present invention.
Figure 2:
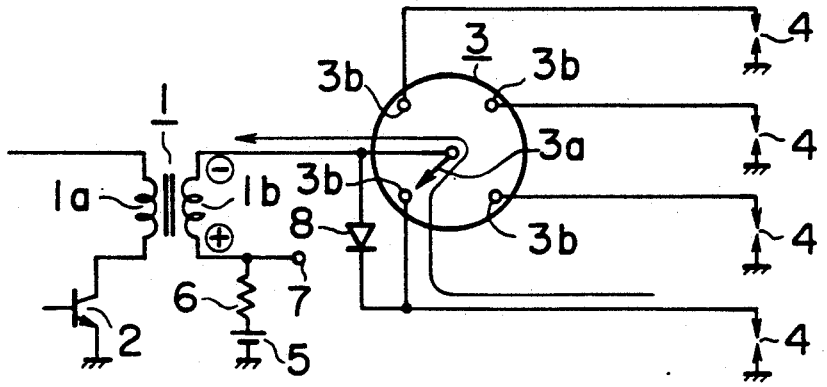
FIG. 2 is a circuit diagram of the embodiment of FIG. 1, showing the path of current when one of the spark plugs is discharging.
Figure 3:
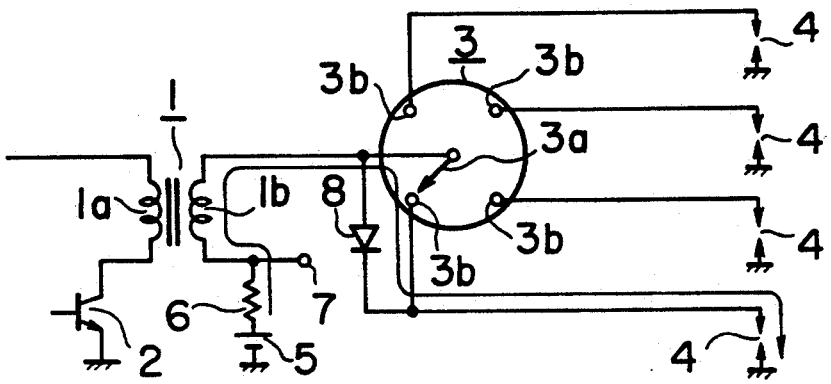
FIG. 3 is a circuit diagram of the embodiment of FIG. 1, showing the path of current when ionic current is flowing between the electrodes of a spark plug.

A number of preferred embodiments of an ionic current sensing apparatus according to the present invention will now be described while referring to the accompanying drawings. FIGS. 1–3 illustrate a first embodiment as applied to a conventional ignition system for an unillustrated multi-cylinder internal combustion engine. The engine in this embodiment has four cylinders, but the number of cylinders is not important. A conventional ignition coil 1 has a primary winding 1*a* and a secondary winding 1*b*. One end of the primary winding 1*a* is connected to an unillustrated power supply, such as a battery, while the other end is connected to a switching device for controlling the flow of current through the primary winding 1*a*. The switching device in this embodiment is a power transistor 2 having its collector connected to the primary winding 1*a* and its emitter grounded. It is possible to employ a different type of switching device, such as the mechanical breaker points of a distributor. The switching of the power transistor 2 is controlled by a conventional, unillustrated control unit.

The ignition system includes a distributor 3 having a rotating central electrode 3*a* and a plurality of stationary peripheral electrodes 3*b* surrounding the central electrode 3*a*. As the central electrode 3*a* rotates, it successively contacts each of the peripheral electrodes 3*b*.

The engine has a plurality of spark plugs 4, each of which has a center electrode connected to one of the peripheral electrodes 3*b* and a ground electrode which is grounded.

One end of the secondary winding 1*b* of the ignition coil 1 is connected to the central electrode 3*a* of the distributor 3 while the other end is connected in series with a direct current power supply 5 and a current sensor comprising a current sensing resistor 6. The power supply 5 can be any device capable of generating a direct current voltage of suitable magnitude, such as a battery or a direct current generator. A terminal 7 is connected to one end of the resistor 6 for measuring the change in the voltage across the resistor 6 due to ionic current flowing between the electrodes of one of the spark plugs 4. The polarity of the power supply 5 is such as to apply a positive voltage between the center electrode and the ground electrode of one of the spark plugs 4. A typical value of the voltage generated by the power supply is 300 volts. A rectifying element in the form of a diode 8 for preventing reverse flow of current has its anode electrically connected to the central electrode 3*a* of the distributor 3 and its cathode electrically connected to the center electrode of one of the spark plugs 4. Other devices besides a diode can be used as the rectifying element, such as a silicon controlled rectifier. It is not necessary for the cathode of the diode 8 to be physically connected to the spark plug 4, and for compactness, it is possible to dispose the diode in the distributor 3 and physically connect it between the central electrode 3*a* and one of the peripheral electrodes 3*b*.

As the engine operates, the central electrode 3*a* of the distributor 3 rotates. When the central electrode 3*a* contacts the peripheral electrode 3*b* corresponding to a cylinder which is to be ignited, the power transistor 2 is turned off by the unillustrated control unit to cut off the current flowing through the primary winding 1*a*, and a high voltage (generally 10–25 kV) having the polarity illustrated in FIG. 2 is generated in the secondary winding 1*b*. This voltage causes one of the spark plugs 4 to discharge, and a discharge current flows from the spark plug 4 through one of the peripheral electrodes 3*b* and into the central electrode 3*a* as shown by the arrow in FIG. 2. The discharge of the spark plug 4 ignites the fuel-air mixture in the corresponding cylinder, and combustion takes place.

Ionization is produced in the cylinder at the time of combustion of the fuel-air mixture in the cylinder, and ions are generated between the electrodes of the spark plug 4. The positive voltage generated by the power supply 5 causes an ionic current to flow between the electrodes, and this causes an electric current to flow through the resistor 6 in the direction shown by the arrow in FIG. 3. This current produces a change in the voltage at the terminal 7 corresponding to the magnitude of the ionic current. Due to the positive polarity of the voltage applied between the electrodes of the spark plug 4, the ionic current is caused by the flow of electrons. As the mass of electrons is far smaller than the mass of positive ions, their speed of movement is much higher, so the magnitude of the ionic current is much larger (generally 10–50 times as high) than an ionic current due to positive ions generated by a conventional ionic current sensing device. Therefore, the change in the voltage at the terminal 7 is large, and the ionic current can be measured much more easily and reliably.

By measuring the ionic current, it can be determined whether the fuel-air mixture in the cylinder associated with the spark plug 4 ignited properly, and the point at which the cylinder pressure reached a maximum can also be determined.

In the embodiment of FIGS. 1–3, an ionic current is generated between the electrodes of only one of the spark plugs 4. However, if additional rectifying elements like diode 8 are connected between the central electrode 3*a* of the distributor and the center electrode of each of the other spark plugs 4, ionic current can be measured in each of the cylinders in turn using only a single current sensing resistor 6.

Figure 4:
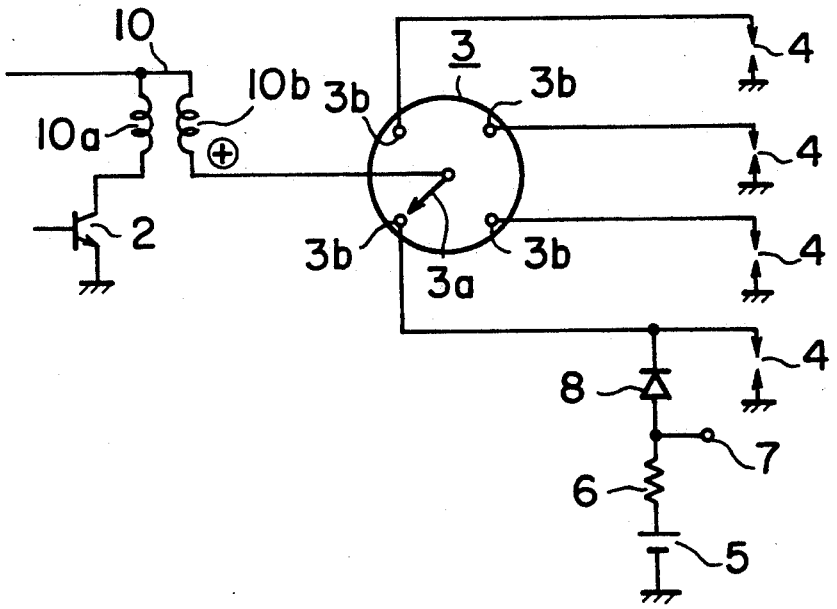
FIG. 4 is a circuit diagram of a second embodiment of an ionic current sensing apparatus according to the present invention.
Figure 5:
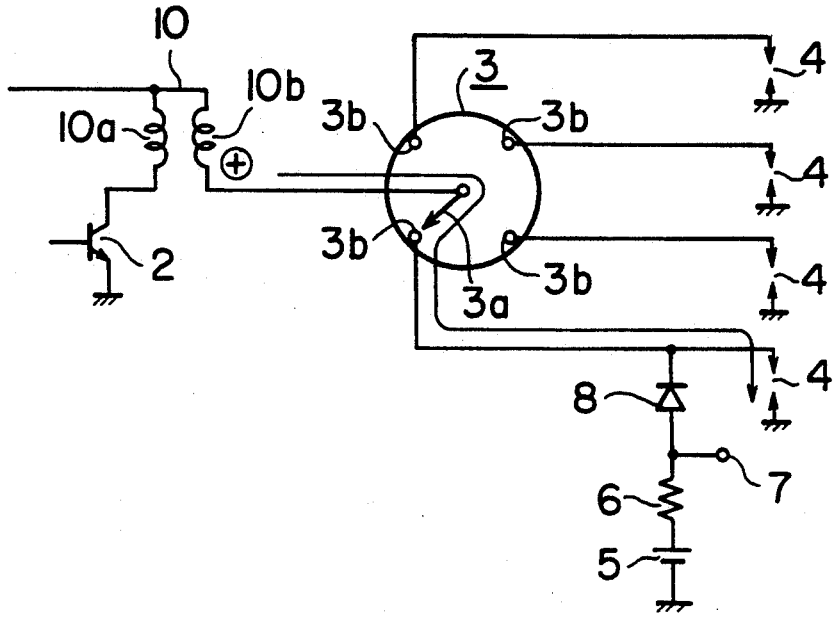
FIG. 5 is a circuit diagram of the embodiment of FIG. 4, showing the path of current when one of the spark plugs is discharging.
Figure 6:
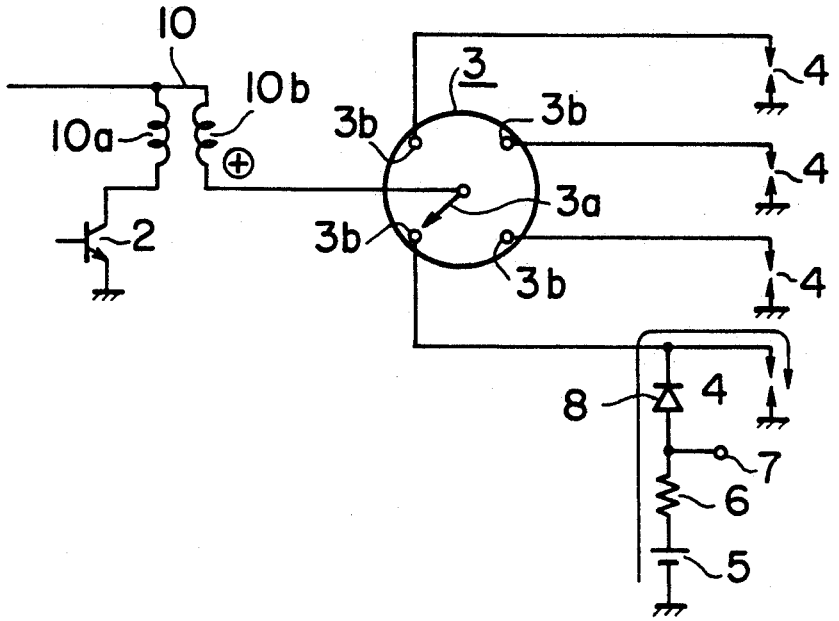
FIG. 6 is a circuit diagram of the embodiment of FIG. 4, showing the path of current when ionic current is generated.

FIGS. 4–6 illustrate a second embodiment of the present invention. This embodiment employs an ignition coil 10 of the type having a primary winding 10*a* and a secondary winding 10*b* each having one end connected to an unillustrated power supply such as a battery. The other end of the primary winding 10*a* is connected to a switching device such as a power transistor 2 controlled by an unillustrated control unit, as in the embodiment of FIG. 1. The other end of the secondary winding 10*b* is connected to the central electrode 3*a* of a distributor 3 similar to the distributor 3 of FIG. 1. The distributor 3 has a plurality of peripheral electrodes 3*b*, each of which is connected to the center electrode of a spark plug 4.

A direct current power supply 5, a current sensor in the form of a resistor 6, and a rectifying element in the form of a diode 8 are connected in series between the center electrode of one of the spark plugs 4 and ground, and a terminal 7 is connected to one end of the resistor 6 for measuring the change in the voltage across the resistor 6 due to ionic current. The polarity of the power supply 5 is such as to apply a positive voltage between the center electrode and the ground electrode of the spark plug 4. The voltage of the power supply 5 can be in the same range as in the embodiment of FIG. 1.

When the central electrode 3*a* of the distributor 3 contacts the peripheral electrode 3*b* corresponding to a cylinder which is to be ignited, the power transistor 2 is turned off by the unillustrated control unit to cut off the current flowing through the primary winding 1*a*, and a high voltage (generally 10–25 kV) having the polarity illustrated in FIG. 5 is generated in the secondary winding 1*b*. This voltage causes one of the spark plugs 4 to discharge, and a discharge current flows from the spark plug through one of the peripheral electrodes 3*b* and into the central electrode 3*a* as shown by the arrow in FIG. 5. The discharge of the spark plug 4 ignites the fuel-air mixture in the corresponding cylinder, and combustion takes place.

The discharge produces ionization of the fuel-air mixture, and ions are generated between the electrodes of the spark plug 4. The positive voltage generated by the power supply 5 causes an ionic current to flow between the electrodes, and this causes an electric current to flow in the direction shown by the arrow in FIG. 6 through the resistor 6 and the diode 8. This electric current produces a change in the voltage at the terminal 7 corresponding to the magnitude of the ionic current. As in the previous embodiment, the ionic current between the electrodes of the spark plug 4 is due to the flow of electrons, so the magnitude of the ionic current is much larger (generally 10–50 times as high) than the ionic current generated by a conventional ionic current sensing device which measures the flow of positive ions. Therefore, the ionic current can be measured much more easily and reliably.

The embodiment of FIGS. 4–6 measures the ionic current flowing in only one cylinder of the engine. However, if a power supply 5, a resistor 6, and a diode 8 are connected in series between ground and the center electrode of each of the spark plugs 4, it is possible to measure the ionic current in each cylinder.

Figure 7:
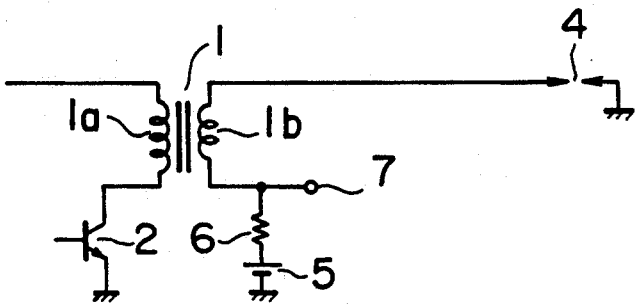
FIG. 7 is a circuit diagram of a third embodiment of an ionic current sensing apparatus according to the present invention.
Figure 8:
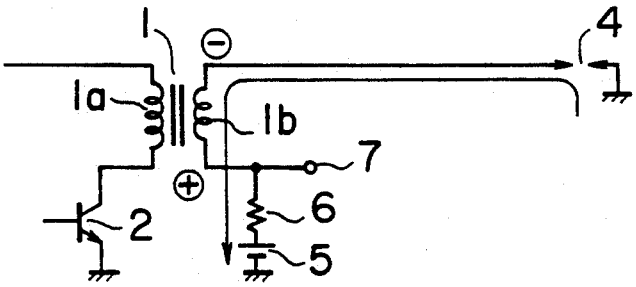
FIG. 8 is a circuit diagram of the embodiment of FIG. 7, showing the path of current when a spark plug is discharging.
Figure 9:
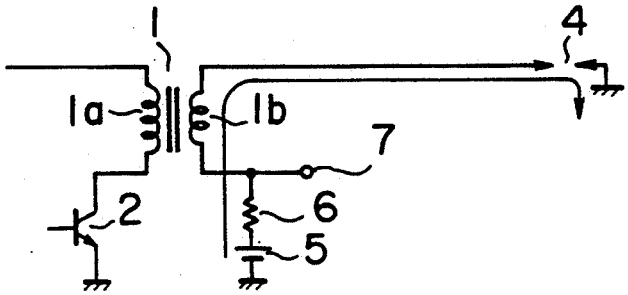
FIG. 9 is a circuit diagram of the embodiment of FIG. 7, showing the path of current when ionic current is generated.

FIGS. 7–9 illustrate a third embodiment of the present invention in which an ignition coil 1 is connected directly to a spark plug 4 rather than to a distributor. This embodiment employs the same type of ignition coil 1 as in the embodiment of FIG. 1. The ignition coil 1 has a primary winding 1*a* and a secondary winding 1*b*. One end of the primary winding la is connected to an unillustrated power supply such as a battery, while the other end is connected to a power transistor 2 which is switched on and off by an unillustrated control unit. One end of the secondary winding 1*b* is connected to the center electrode of a spark plug 4 installed in a cylinder of an engine, while the other end is connected in series with a power supply 5 and a current sensing resistor 6 to ground. A terminal 7 is connected to one end of the resistor 6 for measuring the change in voltage across the resistor 6 due to ionic current. The polarity of the power supply 5 is such as to apply a positive voltage between the center electrode and the ground electrode of the spark plug 4. The voltage of the power supply 5 can be in the same range as in the embodiment of FIG. 1.

When the spark plug 4 is to be fired, the power transistor 2 is turned off by the unillustrated control unit to cut off the current flowing through the primary winding 1*a*, and a high voltage having the polarity illustrated in FIG. 8 is generated in the secondary winding 1*b*. This voltage causes the spark plug 4 connected to the secondary winding 1*b* to discharge, and a discharge current flows in the direction shown by the arrow in FIG. 8. The discharge of the spark plug 4 ignites the fuel-air mixture in the corresponding cylinder, and combustion takes place.

Ionization is produced at the time of combustion of the fuel-air mixture in the cylinder, and ions are generated between the electrodes of the spark plug 4. The positive voltage generated by the power supply 5 causes an ionic current to flow between the electrodes of the spark plug 4, and this causes an electric current to flow in the direction shown by the arrow in FIG. 9 through the resistor 6. This current produces a change in the voltage at the terminal 7 corresponding to the magnitude of the ionic current. Since the ionic current is due to the flow of electrons, the magnitude of the ionic current is much larger than the ionic current generated by a conventional ionic current sensing device which measures the flow of positive ions. Therefore, as in the preceding embodiments, the ionic current can be measured much more easily and reliably.

Figure 10:
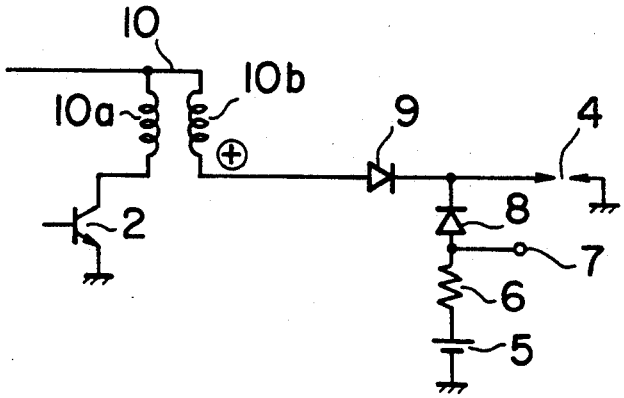
FIG. 10 is a circuit diagram of a fourth embodiment of an ionic current sensing apparatus according to the present invention.
Figure 11:
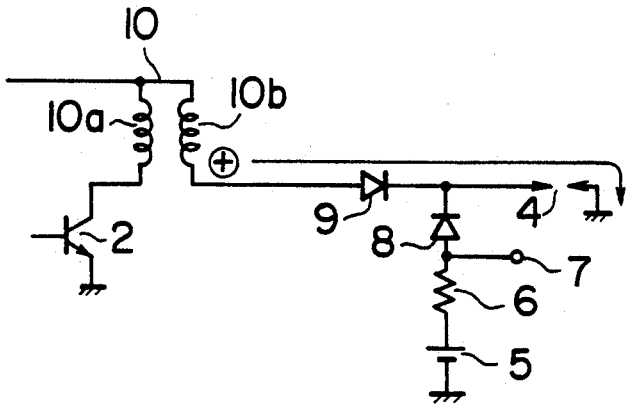
FIG. 11 is a circuit diagram of the embodiment of FIG. 10, showing the path of current when a spark plug is discharging.
Figure 12:
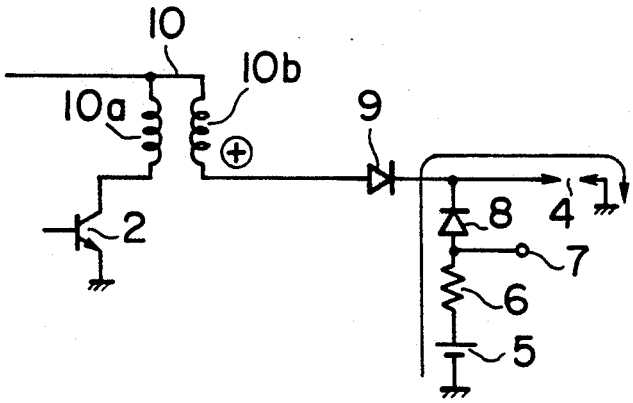
FIG. 12 is a circuit diagram of the embodiment of FIG. 10, showing the path of current when ionic current is generated.

FIGS. 10–12 illustrate another embodiment of the present invention as applied to an ignition system without a distributor. This embodiment employs the same type of ignition coil 10 as in the embodiment of FIG. 5. The ignition coil 10 has a primary winding 10*a* and a secondary winding 10*b*. One end of the primary winding 10*a* is connected to an unillustrated power supply such as a battery and the other end is connected to a power transistor 2 which is switched on and off by an unillustrated control unit. One end of the secondary winding 10*b* is also connected to the power supply, while the other end is connected to the anode of a rectifying element such as a diode 9. The cathode of the diode 9 is connected to the center electrode of a spark plug 4 of one of the cylinders of an engine. The cathode of diode 9 is also connected to ground through a series circuit comprising a power supply 5, a current sensing resistor 6, and a rectifying element in the form of a diode 8 with its anode connected to the resistor 6 and its cathode connected to diode 9. A terminal 7 is connected to one end of the resistor 6 for measuring the change in voltage across the resistor 6 due to ionic current. The polarity of the power supply 5 is such as to apply a positive voltage between the center electrode and the ground electrode of the spark plug 4. The voltage of the power supply 5 can be in the same range as in the embodiment of FIG. 1.

When the spark plug 4 is to be fired, the power transistor 2 is turned off by the unillustrated control unit to cut off the current flowing through the primary winding 10*a*, and a high voltage having the polarity illustrated in FIG. 11 is generated in the secondary winding 10*b*. This voltage causes the spark plug 4 connected to the secondary winding 10*b* to discharge, and a discharge current flows in the direction shown by the arrow in FIG. 11. The discharge of the spark plug 4 ignites the fuel-air mixture in the corresponding cylinder, and combustion takes place.

Ionization is produced at the time of combustion of the fuel-air mixture, and ions are generated between the electrodes of the spark plug 4. The positive voltage generated by the power supply 5 causes an ionic current to flow between the electrodes, and this causes an electric current to flow in the direction shown by the arrow in FIG. 12 through the resistor 6. This current produces a change in the voltage at the terminal 7 corresponding to the magnitude of the ionic current. Since the ionic current is due to the flow of electrons, the magnitude of the ionic current is much larger than the ionic current generated by a conventional ionic current sensing device which measures the flow of positive ions. Therefore, the ionic current can be measured much more easily and reliably.

Figure 13:
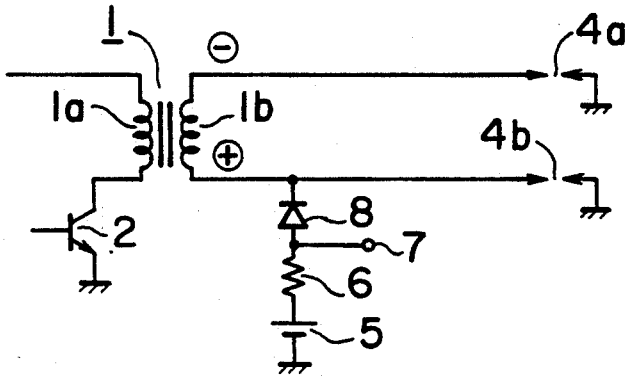
FIG. 13 is a circuit diagram of a fifth embodiment of an ionic current sensing apparatus according to the present invention.
Figure 14:
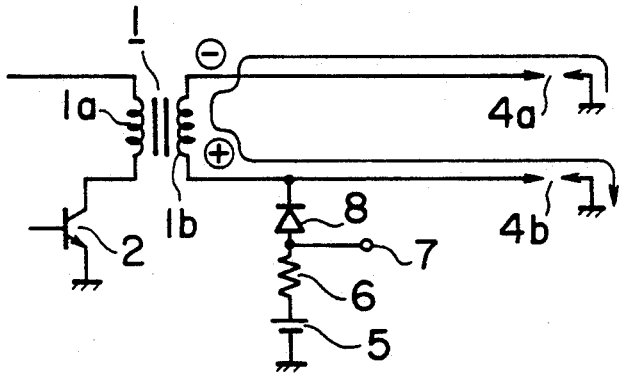
FIG. 14 is a circuit diagram of the embodiment of FIG. 13, showing the path of current when either of the spark plugs is discharging.
Figure 15:
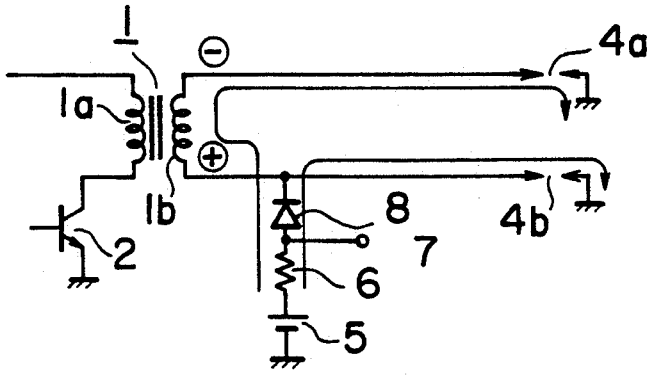
FIG. 15 is a circuit diagram of the embodiment of FIG. 13, showing the path of current when ionic current is generated.

FIGS. 13–15 illustrate yet another embodiment of the present invention. In this embodiment, the present invention is applied to an ignition system of the so-called simultaneous ignition type in which a plurality of spark plugs in an engine are fired substantially simultaneously, but only the cylinder corresponding to one of the spark plugs contains a fuel-air mixture at the time of firing. An ignition coil 1 like that employed in the embodiment of FIG. 1 is used in this embodiment. It has a primary winding 1*a* and a secondary winding 1*b*. One end of the primary winding 1*a* is connected to an unillustrated power supply such as a battery and the other end is connected to a power transistor 2 which is controlled by an unillustrated control unit. One end of the secondary winding 1b is connected to the center electrode of a first spark plug 4a and the other end is connected to the center electrode of a second spark plug 4b which is installed in a different cylinder from the first spark plug 4a. The cylinders housing the first and second spark plugs 4a and 4b are chosen so that the pistons of the two cylinders are out of phase with one another. For example, the cylinders can be chosen so that when the piston of one cylinder is in its compression stroke, the piston of the other cylinder is in its exhaust stroke, in which case the two pistons are 360 degrees out of phase. The positive side of the secondary winding 1b and the center electrode of the second spark plug 4b are connected to ground through a series circuit comprising a power supply 5, a current sensing resistor 6, and a rectifying element in the form of a diode 8. The anode of the diode 8 is connected to the resistor 6 and its cathode is connected to the secondary winding 1b. A terminal 7 is connected to one end of the resistor for measuring the change in the voltage across the resistor 6 due to ionic current. The polarity of the power supply 5 is such as to apply a positive voltage between the center electrode and the ground electrode of each of spark plugs 4a and 4b. The voltage of the power supply 5 can be in the same range as in the embodiment of FIG. 1.

When the fuel-air mixture in one of the cylinders corresponding to spark plugs 4a and 4b is to be ignited, the power transistor 2 is turned off by the unillustrated control unit to cut off the current flowing through the primary winding 10a, and a high voltage having the polarity illustrated in FIG. 14 is generated in the secondary winding 10b. This voltage causes both the first and the second spark plugs 4a and 4b to fire, and a discharge current flows in the direction shown by the arrow in FIG. 14. However, because only one of the cylinders corresponding to the spark plugs contains an uncombusted fuel-air mixture at this time, combustion takes place only in that cylinder.

Ionization is produced at the time of combustion of the fuel-air mixture, and ions are generated between the electrodes of one of the spark plugs. The positive voltage generated by the power supply 5 causes an ionic current to flow between the electrodes of the spark plug, and this causes an electric current to flow in the direction shown by the arrows in FIG. 15 through the resistor 6. This electric current produces a change in the voltage at the terminal 7 corresponding to the magnitude of the ionic current. Since the ionic current is due to the flow of electrons, the magnitude of the ionic current is much larger than the ionic current generated by a conventional ionic current sensing device which measures the flow of positive ions. Therefore, the ionic current can be measured easily and reliably, as in the preceding embodiments.

What is claimed is:

1. An ionic current sensing apparatus for an internal combustion engine comprising:

a first spark plug having a first electrode and a grounded second electrode;

first voltage applying means for applying a negative ignition voltage between the first and second electrodes;

second voltage applying means for applying a positive voltage between the first electrode and the second electrode after a discharge of the first spark plug; and current sensing means for sensing ionic current flowing between the first and second electrodes due to the positive voltages, wherein the first voltage applying means comprises an ignition coil having a secondary winding, and a distributor having a central electrode connected to a high-voltage side of the secondary winding, and a peripheral electrode side of the secondary winding, and a peripheral electrode connected to the first electrode of the first spark plug;

the second voltage applying means comprises a direct current voltage source connected in series with a low-voltage side of the secondary winding, and a rectifying element connected between the central electrode and the peripheral electrode of the distributor; and the current sensing means comprises a current sensing resistor connected in series with and between the low-voltage side of the secondary winding and the voltage source.

2. An ionic current sensing apparatus for an internal combustion engine comprising:

a first spark plug having a first electrode and a grounded second electrode;

first voltage applying means for applying a negative ignition voltage between the first and second electrodes;

second voltage applying means for applying a positive voltage between the first electrode and the second electrode after a discharge of the first spark plug; and current sensing means for sensing ionic current flowing between the first and second electrodes due to the positive voltage, wherein the first voltage applying means comprises an ignition coil having a high-voltage side of a secondary winding connected to the first electrode of the first spark plug;

the second voltage applying means comprises a direct current voltage source connected in series with a low-voltage side of the secondary winding; and the current sensing means comprises a current sensing resistor connected in series with and between the low-voltage side of the secondary winding and the voltage source.

3. An ionic current sensing apparatus for an internal combustion engine comprising:

a spark plug having a first electrode and a grounded second electrode;

a distributor having a central electrode and a plurality of peripheral electrodes, one of the peripheral electrodes being connected to the first electrode of the spark plug;

a rectifying element connected between the central electrode of the distributor and the first electrode of the spark plug;

an ignition coil having a secondary winding with a high-voltage negative end connected to the central electrode of the distributor and a low-voltage positive end, for applying a negative ignition voltage between the first and second electrodes; and a direct current voltage source and a current sensing resistor for sensing ionic current flowing between the first and second electrodes, connected in series between ground and the low-voltage positive end of the secondary winding, the voltage source having a polarity so as to apply a positive voltage between the first and second electrodes of the spark plug.

4. An ionic current sensing apparatus for an internal combustion engine comprising:

a spark plug having a first electrode and a grounded second electrode;

an ignition coil having a secondary winding with a first, high voltage end connected to the first electrode of the spark plug and a second, low-voltage end for applying a negative ignition voltage between the first and second electrodes; and a direct current voltage source and a current sensing resistor for sensing ionic current flowing between the first and second electrodes, connected in series between ground and the second, low-voltage end of the secondary winding, the voltage source having a polarity so as to apply a positive voltage between the first and second electrodes of the spark plug.

5. An ionic current sensing method comprising the steps of:

applying a negative discharge voltage derived from a high-voltage side of an ignition coil secondary winding between a center electrode and a ground electrode of a spark plug for a cylinder of an internal combustion engine;

applying a positive voltage between the center electrode and the ground electrode after applying the discharge voltage; and measuring the current flowing between the electrodes due to the positive voltage, wherein the step of measuring the current comprises measuring the voltage drop across a resistor electrically connected in series between a low-voltage side of the ignition coil secondary winding and a source of the positive voltage.

* * * * *